US007410366B2

(12) United States Patent
Wu

(10) Patent No.: US 7,410,366 B2
(45) Date of Patent: Aug. 12, 2008

(54) ELECTRICAL CONNECTOR ASSEMBLY WITH REDUCED CROSSTALK AND ELECTROMAGANECTIC INTERFERENCE

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 27 days.

(21) Appl. No.: 11/510,201

(22) Filed: Aug. 25, 2006

(65) Prior Publication Data

US 2008/0050951 A1 Feb. 28, 2008

(51) Int. Cl.
*H01R 12/00* (2006.01)

(52) U.S. Cl. ..... 439/76.1; 439/660; 439/941

(58) Field of Classification Search ..... 439/76.1, 439/660, 941

See application file for complete search history.

(56) References Cited

U.S. PATENT DOCUMENTS 5,547,405 A 8/1996 Pinney et al.
5,626,497 A 5/1997 Bouchan et al.
6,206,734 B1 * 3/2001 Liu ..... 439/676
6,371,793 B1 * 4/2002 Doorhy et al. ..... 439/404
6,428,362 B1 * 8/2002 Phommachanh ..... 439/676
6,579,127 B2 6/2003 Hess et al.
6,964,587 B2 11/2005 Colantuono et al.
7,037,140 B2 * 5/2006 Aekins et al. ..... 439/676
7,175,478 B2 * 2/2007 Ollivier ..... 439/669
7,270,551 B2 * 9/2007 Busse et al. ..... 439/76.1

* cited by examiner

*Primary Examiner*—Gary F. Paumen
(74) *Attorney, Agent, or Firm*—Wei Te Chung

(57) ABSTRACT

An electrical connector assembly (100) comprise an insulative housing (1) defining a mating direction, a plurality of terminals (2) received in the insulative housing (1) along the mating direction, a printed circuit board (3) attached to the insulative housing (1) and electrically connected to the terminals (2) and a cable (4) comprising a plurality of conductors (40) electrically attached to the printed circuit board (3). Each terminal (2) has a mating portion (23), a tail portion (21) and an enlarged interconnecting portion (22) connecting with the mating portion (23) and the tail portion (21).

20 Claims, 7 Drawing Sheets

ELECTRICAL CONNECTOR ASSEMBLY WITH REDUCED CROSSTALK AND ELECTROMAGANECTIC INTERFERENCE

CROSS-REFERENCE TO RELATED APPLICATION

This application is related to U.S. patent application Ser. No. 11/481,672, filed on Jul. 5, 2006, and entitled "ELECTRICAL CONNECTOR ASSEMBLY HAVING IMPROVED SHELL", which has the same applicant and assignee as the present invention. The disclosure of related application is incorporated herein by reference.

BACKGROUND OF THE INVENTION

1. Field of the Invention

The present invention relates generally to an electrical connector assembly, and more particularly to an electrical connector assembly for transmitting high-speed signals between two electrical devices.

2. Description of Related Arts

DisplayPort is a new digital display interface standard (approved in May 2006) put forth by the VESA (Video Electronics Standards Association). The standard defines a new license-free state-of-the-art digital audio/video interconnect, intended to be used primarily between a computer and its display-monitor, or a computer and a home-theater system. It is with many advantages relative to HDMI (High Definition Multimedia Interface) and DVI (Digital Visual Interface), such as 10 Gbit/s forward link channel supports high resolution monitors, Royalty free except for encryption portion while HDMI is not, and Supports internal and external connections so that one standard can be used by computer makers reducing costs etc. A displayport connector comprises a metal shell, an insulative housing received in the metal shell and with a plurality of terminals received therein, a plurality of cables respectively electrically connected with the terminals, a dielectric housing over-molded to the shell and the cables.

As is well known in this art, such a high performance type connectors are quite small or miniaturized and, consequently, the terminals are very closely spaced. Consequently, there exists a never-ending problem of noise or crosstalk between adjacent terminals, particularly in elongated straight/parallel portions of the terminals. Efforts have been made to reduce or even eliminate the crosstalk in variety of electrical applications such as providing ground planes on the connector, and coupling filter components, such as capacitor filters, between the terminals and the ground plane. Adding such additional components as coupling filter components to such miniaturized connectors is difficult and costly.

An electrical connector assembly is, therefore, desired that provides high performance data transmission, that is simple and economical to produce, and that facilitates optimum data transfer with increasing frequency of transmission without signal degradation due to the crosstalk and EMI.

SUMMARY OF THE INVENTION

Accordingly, the object of the present invention is to provide an electrical connector assembly for high performance applications with enhanced corsstalk compensation features.

Accordingly, another object of the present invention is to provide an electrical connector assembly for high performance data transmission that is simple and economical to produce.

To achieve the above object, an electrical connector assembly in according with the present invention comprises an insulative housing defining a mating direction, a plurality of terminals received in the insulative housing along the mating direction, a printed circuit board attached to the insulative housing and electrically connected to the terminals and a cable comprising a plurality of conductors electrically attached to the printed circuit board. Each terminal has a mating portion, a tail portion and an enlarged interconnecting portion connecting with the mating portion and the tail portion. The terminals further comprise a plurality of first terminals for transmitting signal and a plurality of second terminals for transmitting power, the first terminals are arranged in a line along the transversal direction perpendicular to the mating direction, the enlarged interconnecting portions of the first terminals are parallel to one another and separated by a dielectric at predetermined distance such that a capacitor is formed.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
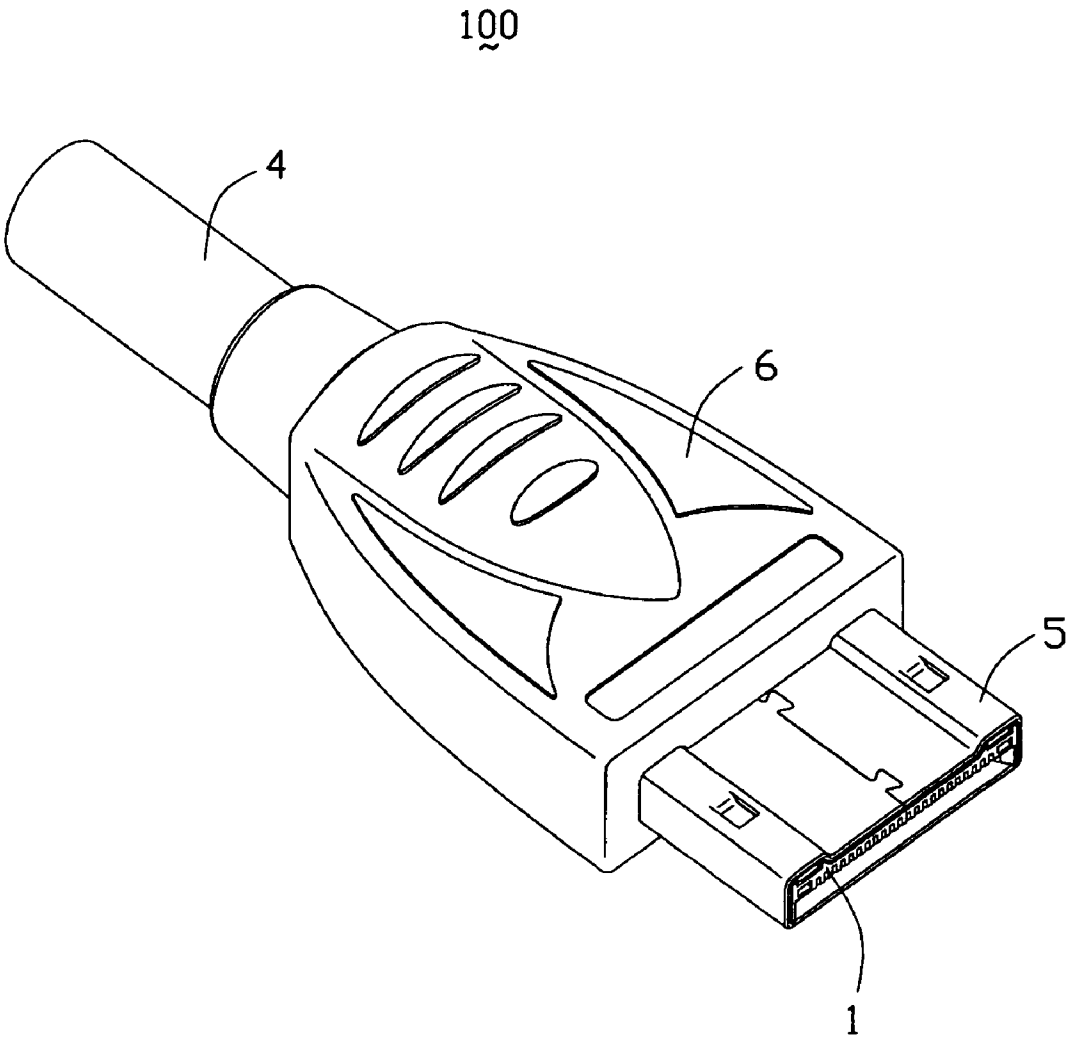
FIG. 1 is a perspective, assembled view of an electrical connector assembly in accordance with the present invention.
Figure 2:
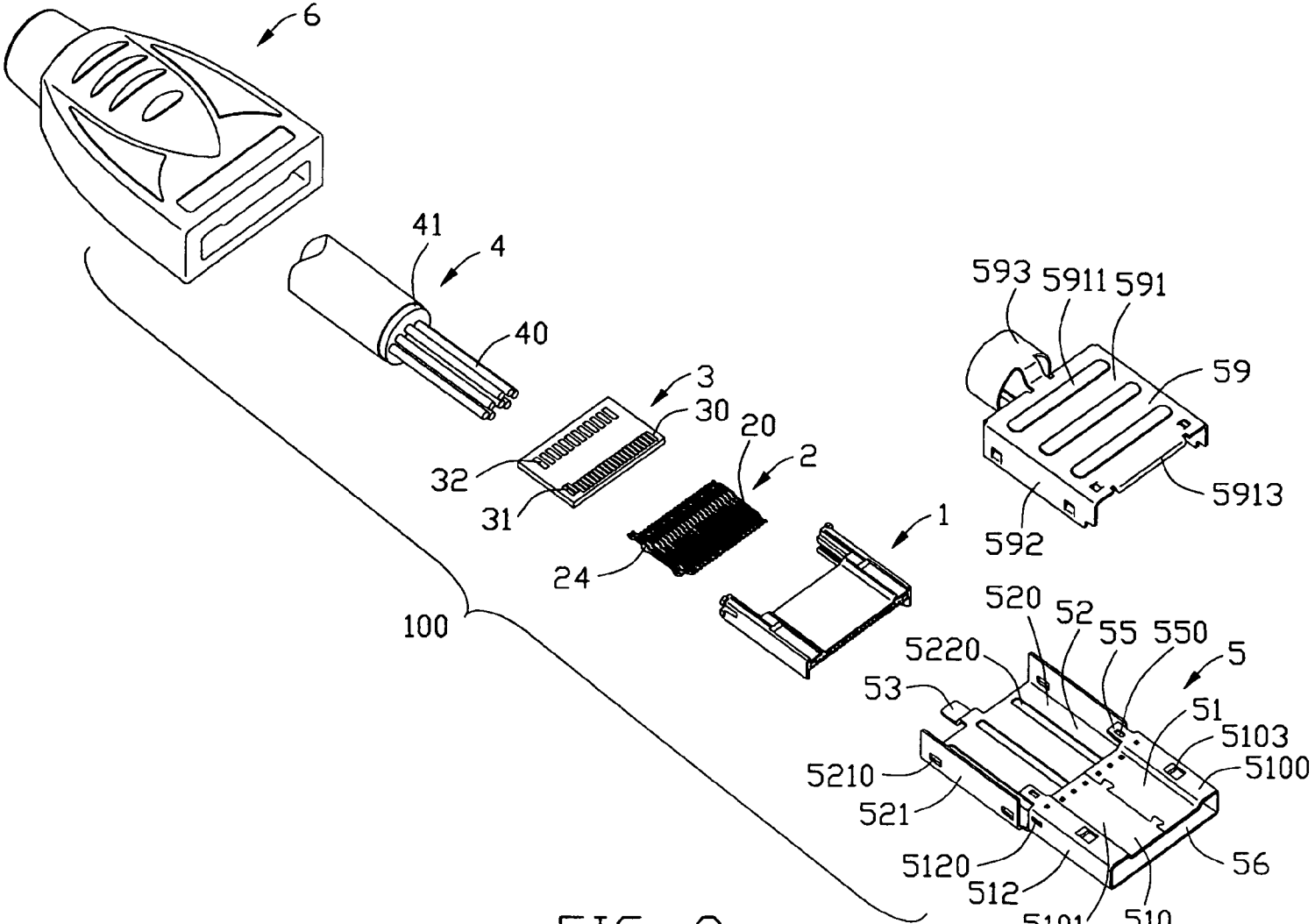
FIG. 2 is a perspective, exploded view of the electrical connector assembly of FIG. 1.
Figure 3:
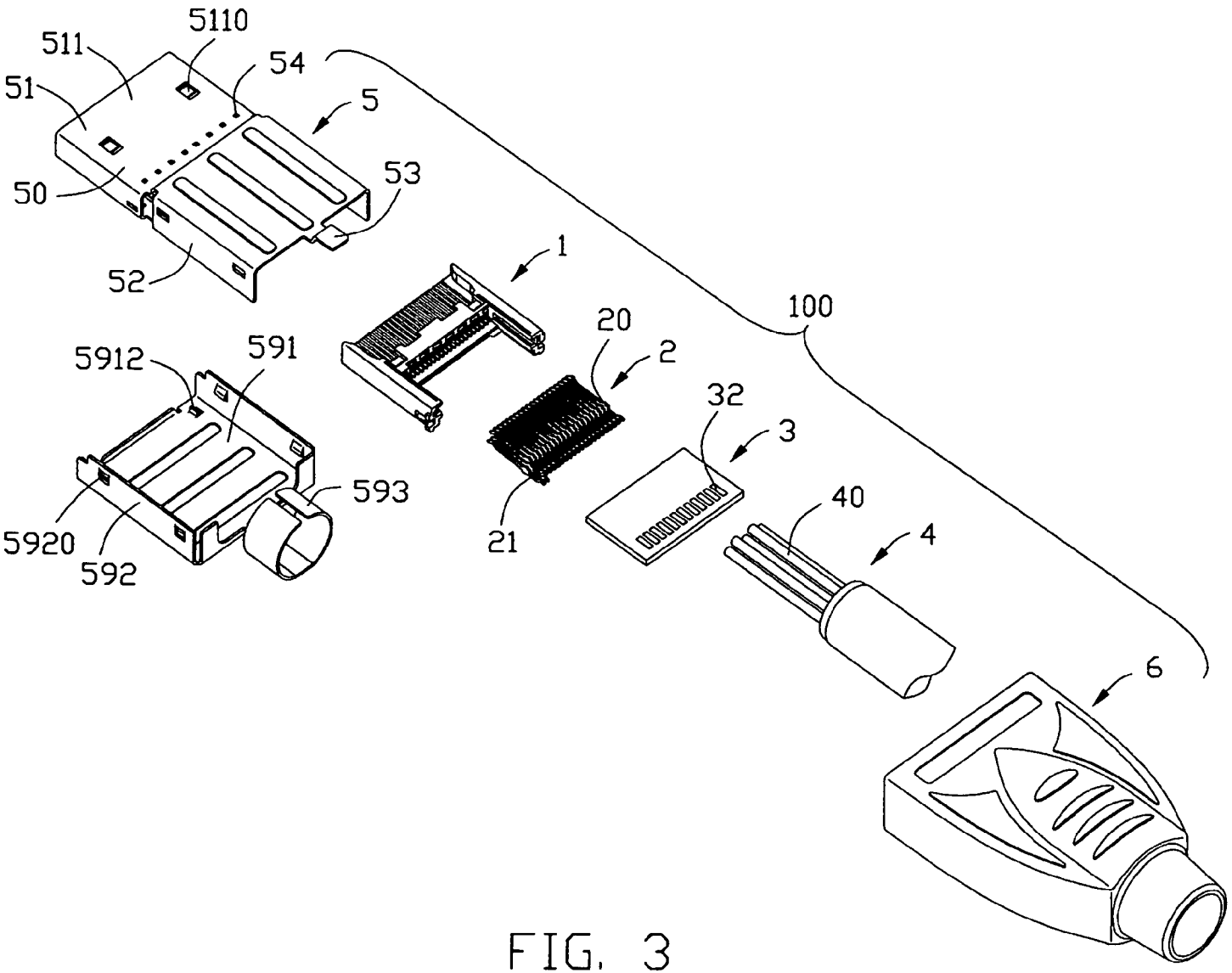
FIG. 3 is a view similar to FIG. 2, but taken from a different aspect.
Figure 4:
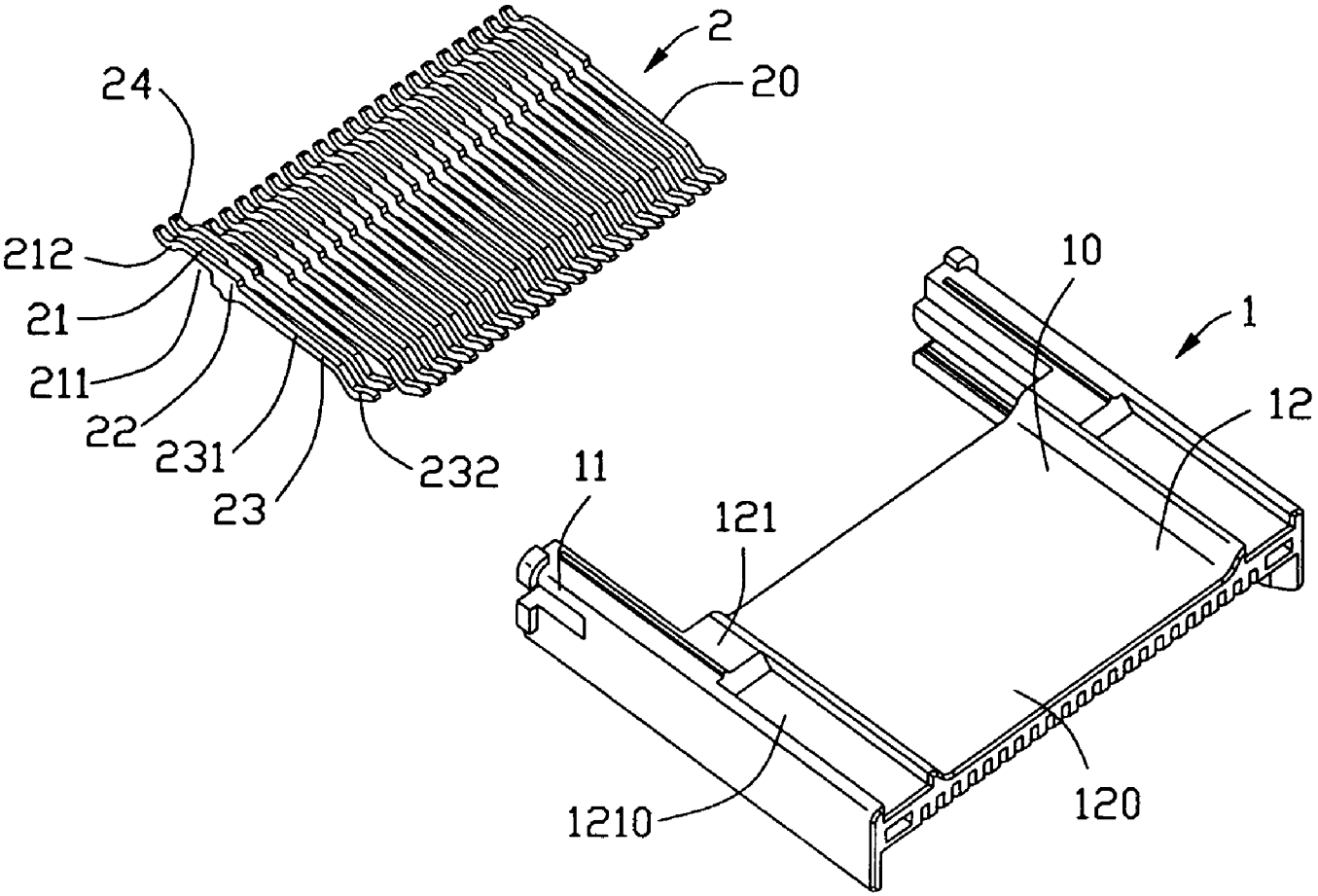
FIG. 4 is an exploded, perspective view of the electrical connector assembly shown in FIG. 1, illustrating a plurality of terminals and an insulative housing.
Figure 5:
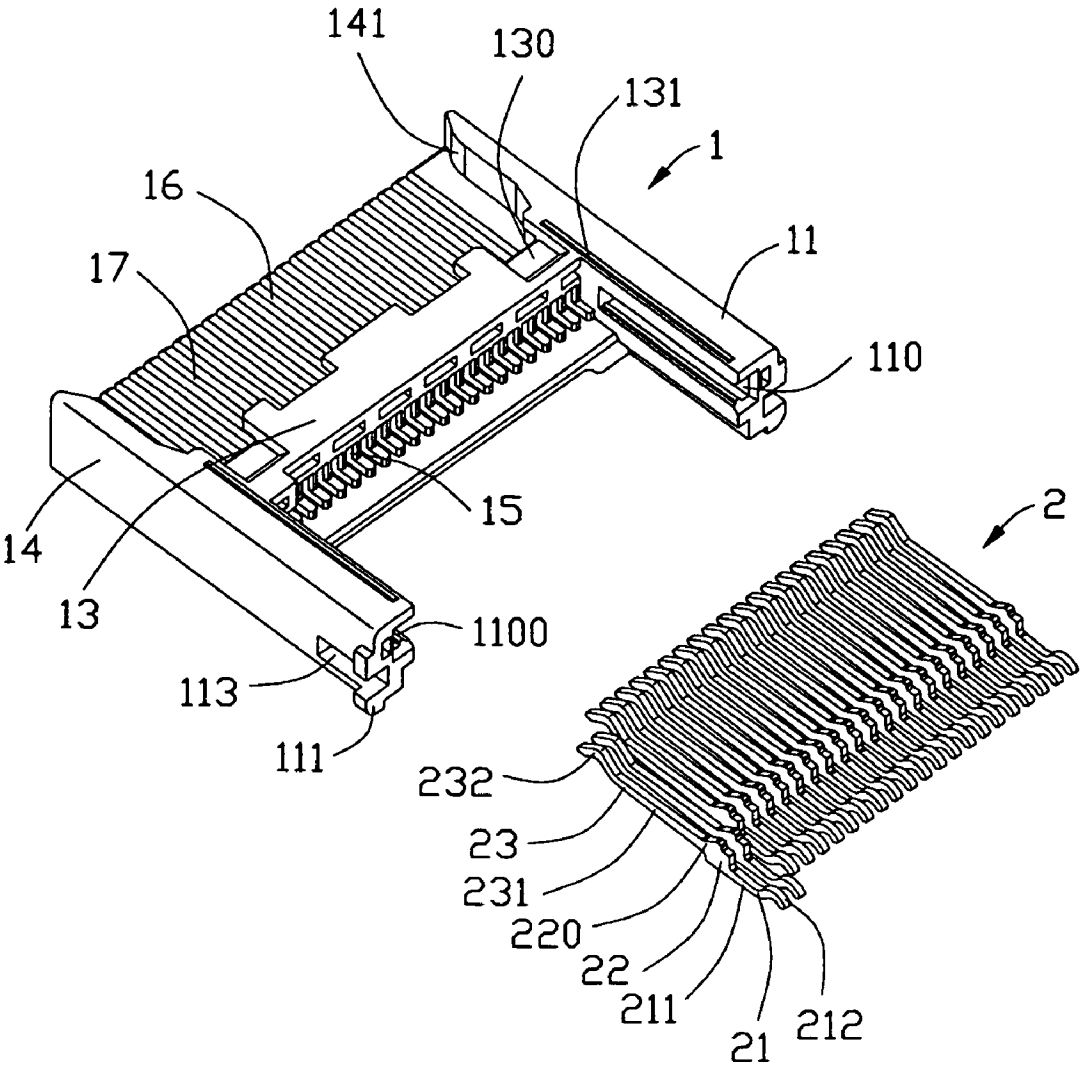
FIG. 5 is a view similar to FIG. 4, but taken from a different aspect.
Figure 6:
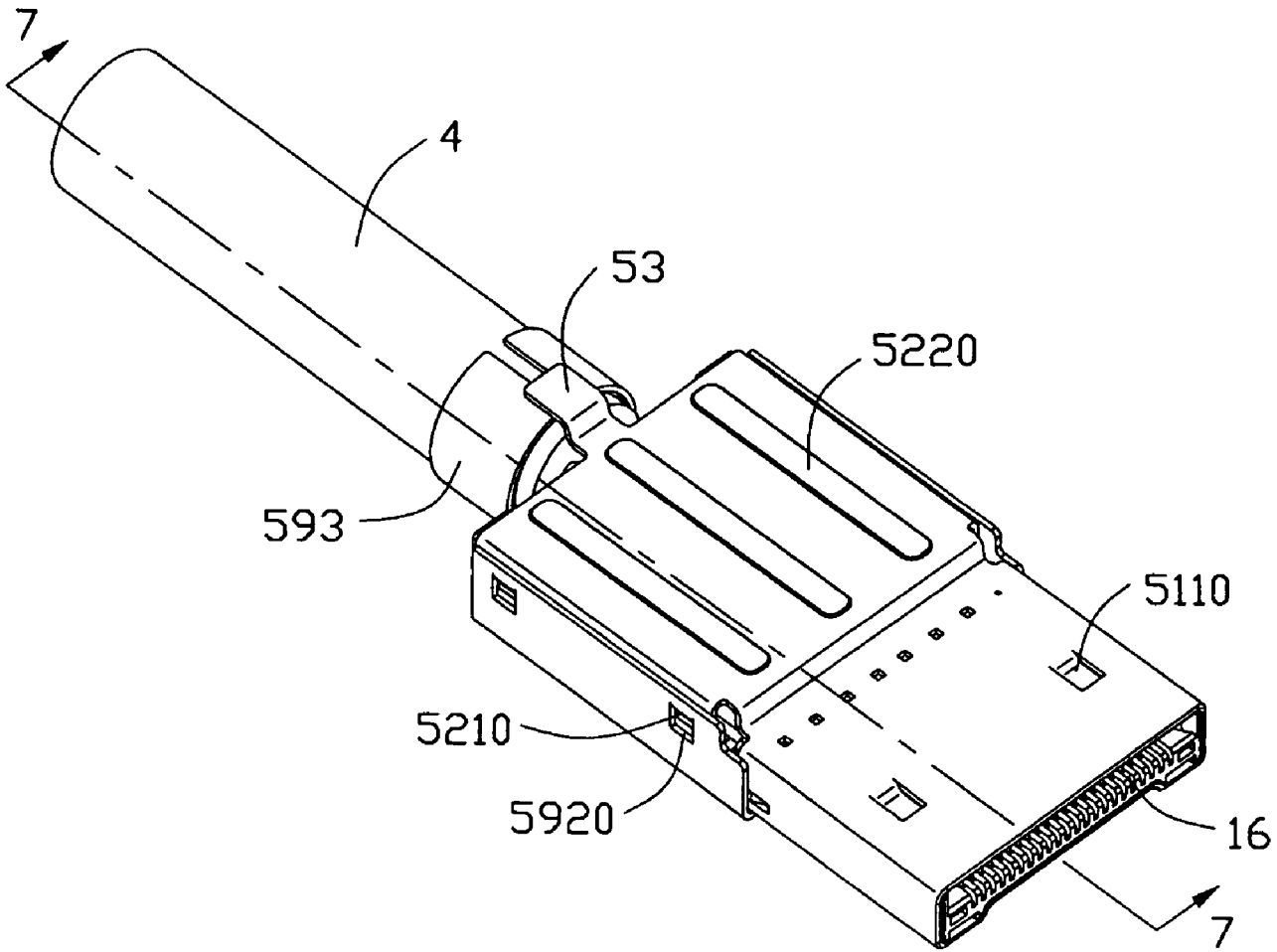
FIG. 6 is a partially assembled, perspective view of the electrical connector assembly in according with the present invention without a protecting cover being molded with the shell.

Referring to FIGS. 1-3, an electrical connector assembly 100 in accordance with the present invention defines a mating direction and a mating interface, and comprises an insulative housing 1, a plurality of terminals (or contacts) 2 received in the insulative housing 1 therein, a printed circuit bard 3 attached to the insulative housing 1 and electrically connected to the terminals 2, a cable 4 electrically connected to the printed circuit board 3, a metal shell 5 surrounding the insulative housing 1, the printed circuit board 3, and a protecting cover 6 partially enclosing the metal shell 5 and the front end of the cable 4.

Referring to FIGS. 2-5, the insulative housing 1 defines a base portion 10, and a pair of connecting portions 11 unitarily formed with and rearwardly extending from the base portion 10 along the mating direction, The insulative housing 1 is formed of an upper wall 12, a lower wall 13 extending parallel to the upper wall 12 and being shorter than the upper wall 12 and a pair of lateral walls 14 extending between the upper and lower walls 12, 13. Specially referring to FIG. 5. the upper wall 12 may be regarded as two distinct parts, a primary part (not numbered) is substantially portion of the insulative housing 1 and has equal length as that of the lower wall 11, and a bottom plate (not numbered) extends rearwardly from a rear face of the primary part. The upper, lower and lateral walls 12, 13, 14 together define the receiving space. In a preferred embodiment, the receiving space is divided into three parts, a plurality of passageways 15 defined between inner surfaces of the upper wall 12 and the lower wall 13 and spaced from one another, a plurality of slots 16 slotted in front portion of the upper wall 12 and communicated with corresponding passageways 15 along the mating direction, and an mating space 17 defined by the upper wall 12 and the pair of lateral walls 14, and communicated with the passageways 15 and the slots 16 for receiving a complementary connector (not shown).

The upper wall 12 comprises a pair of lateral portions 121 respectively disposed adjacent to the lateral walls 14, and a generally flat part 120 disposed between the lateral portions 121 and depressed a predetermined distance relative to the lateral portions 121. Each lateral portion 121 comprises a recess 1210 depressed downwardly therefrom and extending rearwardly a given distance from a front surface thereof and stopped at a location adjacent to a rear surface thereof. The lower wall 13 is generally flat, and comprises a pair of second receiving slots 130 rearwardly extending a distance from a front surface thereof, and a pair of ribs 131 formed thereon with a dimension along the mating direction for providing reliable connection when assembled to the metal shell 5. Each lateral wall 14 forms a guiding surface 141 by slantwise cutting a front portion thereof for guiding an insertion of a complementary connector. Further, each connecting portion 11 rearwardly extending from two lateral walls 14 of the base portion 10 comprises a guiding slit 110 formed at a lower position of the inner wall thereof and extending along a back-to-front direction adjacent to the rear side of the passageways 15 for guiding an insertion of the printed circuit board 3, a securing slit 113 formed at a upper position of the outer wall thereof, and a pair of stopper portions 111 disposed at two sides of the securing slit 113 and outwardly extending from the rear edge of the connecting portion 11. In a preferred embodiment, a strip rib 1100 is formed in the guiding slit 110 for reliably retaining the printed circuit board 3 therein. Additionally, one of the pair of the stopper portions 111 only extends beyond a lateral surface of the connecting portion 11, the other of the pair of the stopper portions 111 extends beyond the lateral surface and the upper surface of the connecting portion 11, thereby forming a step structure (not labeled) for allowing the metal shell 5 to slide through. Further, the insulative housing 1 comprises a narrow slot 112 forwardly extending s predetermined distance from a rear surface of the connecting portion 11 toward the base portion 10. Obviously, in a preferred embodiment, the front portion of the base portion 10 with a U-shape cross-sectional view, which comprising the front portion of the upper wall 12 where the slots 16 are formed, the mating space 17 and the front portion of the lateral walls 14, is regarded as the mating interface of the present invention.

Referring to FIGS. 2-5, the terminals (contacts) 2 are stamped of or blanked from a metal shell and a skilled person is familiar with this kind of technique. Each terminal 2 has the same structure and comprises a tail portion 21 for electrically connecting the printed circuit board 3, a mating portion 23 for mating with corresponding terminal of the complementary connector, and a main body having an enlarged interconnecting portion 22 connected the mating portion 23 to the tail portion 21. The tail portion 21 comprises a flat section 211 and a curved soldering section 212 for soldering with the printed circuit board 3. The enlarged interconnecting portion 22 is substantially plate shaped with larger height than that of the mating portion 23 and the tail portion 21 along the vertical direction, and comprises a sting 220 formed on an upper edge thereof for interferentially engaging with inner surface of corresponding passageways 15, other retention means, such as a barb member is available. The mating portion 23 comprises a cantilevering section 231 and a curved contacting section 232 formed on the distal end of the cantilevering section 231. The terminals 2 are divided into two sets respectively to the first terminals 20 and the second terminals 24. The first terminals 20 are used to transmit high-speed signals, the second terminals 24 are arranged to locate a little backwardly with respective to the first terminals 20 along the mating direction for detecting a hot-plug when the electrical connector assembly 100 engages with the complementary connector. Alternatively, the second terminals 24 can be usual type terminals without larger height along the vertical direction.

Referring to FIGS. 2-3, the printed circuit board 3 is a generally flat board, and comprises a plurality of first pads 30 formed on one surface and arranged in one row on a front end thereof for electrically connecting with the soldering section 212 of the tail portions 21 of the first terminals 20, a pair of second pads 31 formed adjacent to the first pads 30 for electrically connecting with the tail portions 21 of the second terminals 24, and a plurality of third pads 32 formed on two surfaces on rear end thereof and respectively arranged in one row for electrically connecting with the cable 4. Noticeably, the first pads 30 are located beyond the second pads 31 a predetermined distance along the mating direction. Additionally, the first and second pads 30, 31 are electrically connected with the third pads 32 by inner traces (not shown) formed on the printed circuit board 3.

Referring to FIG. 2, the cable 4 comprises a plurality of conductors 40 for soldering with the third pads 32, an insulator 41 surrounding the conductors 40 for providing a protection, and a grounding layer (not shown) electrically connected with the metal shell 5 for protecting against EMI.

Referring to FIGS. 2-9, the metal shell 5 formed of metal material, comprises a first shell 50, and a second shell 59 assembled with the first shell 50 along a direction perpendicular to the mating direction. However, in a preferred embodiment, the second shell 59 can be assembled to the first shell 50 along the mating direction without departing from the spirit of the present invention.

The first shell 50 comprises a frame-shaped main portion 51, a generally U-shaped extending portion 52 rearwardly extending from the main portion 51, and an reinforcing portion 53 rearwardly extending from middle of a rear edge of the extending portion 52. The main portion 51 comprises a top wall 510, a bottom wall 511 opposite to the top wall 51, and a pair of sidewalls 512 connecting with the top wall 510 and the bottom wall 511. The top, bottom walls 510, 511 and sidewalls 512 together define a receiving cavity 56 for receiving the insulative housing 1 therein. The top wall 510 comprises a pair of lateral protruding portions 5100 disposed in alignment with the lateral portions 121, and a flat portion 5101 depressed a predetermined distance towards the receiving cavity 56 and stepped relative to the lateral protruding portions 5100 and aligned with the flat part 120. Each lateral protruding portion 5100 forms a pair of resilient tabs 5103 bended into the receiving cavity 56 for sliding across the recess 1210 of the lateral portion 121 and preventing the metal shell 5 to be pulled out from the insulative housing 1. The bottom wall 511 comprises a pair of openings 5110 for engaging with the complementary connector. Each sidewall 512 comprises a second resilient tab 5120 formed adjacent to the rear surface thereof and aligned with the securing slit 113 for reliably fixing the insulative housing 1 with the metal shell 5. Both the top wall 510 and the bottom wall 511 all form a plurality of apertures 54 located adjacent to the rear edge thereof.

Additionally, The first shell 50 further comprises a pair of tongue portions 55 respectively extending rearwardly from a rear surface of the lateral protruding portions 5100. Each tongue portion 55 comprises a rectangular aperture 550 disposed in middle thereof. The extending portion 52 with a U-shape cross-sectional view, comprises a lower wall 520 rearwardly extending from the bottom wall 511, a pair of lateral walls 521 opposite to each other and spaced from the lateral walls 512 along the mating direction, and a rear wall 522 with lower height. The lower wall 520, the pair of lateral walls 521 and the rear wall 512 together defines a cavity (not labeled) communicated with the receiving cavity 56. Each lateral wall 521 comprises a pair of rectangular holes 5210. The rear wall 522 defines a cutout 5220 at middle thereof, where the reinforcing portion 53 rearwardly extends therefrom. The lower wall 520 forms a plurality of retentive ribs 5200 extending along the mating direction. Noticeably, the top surface of the rear wall 522 is lower than that of the lateral walls 521.

Referring to FIGS. 2-3, the second shell 59 with a U-shape cross-sectional configuration comprises an upper wall 591, a pair of lateral walls 592 opposite to each other, and a clamping portion 593 extending from the rear side of the upper wall 591. The upper wall 591 and the pair of lateral walls 592 together define a cavity (not labeled) that can enclose the extending portion 52 therein. The upper wall 591 comprises a plurality of retentive ribs 5911 extending along the transversal direction perpendicular to the mating direction, a pair of first latching pieces 5912 punched inwardly towards the cavity and aligned with the apertures 550 for holding the second shell 59 with the first shell 50, and a front curved piece 5913 formed at a front end thereof. Each lateral wall 592 comprises a pair of second latching pieces 5920 inwardly extending towards the cavity for locking with the rectangular holes 5210 of the first shell 50. The clamping portion 593 is bent from a metal sheet to form a circular shaped structure.

Referring to FIGS. 2-3, the protecting cover 6 is molded over rear portions of the housing 1, the print circuit board 3, the cable 4 and the metal shell 5.

Figure 7:
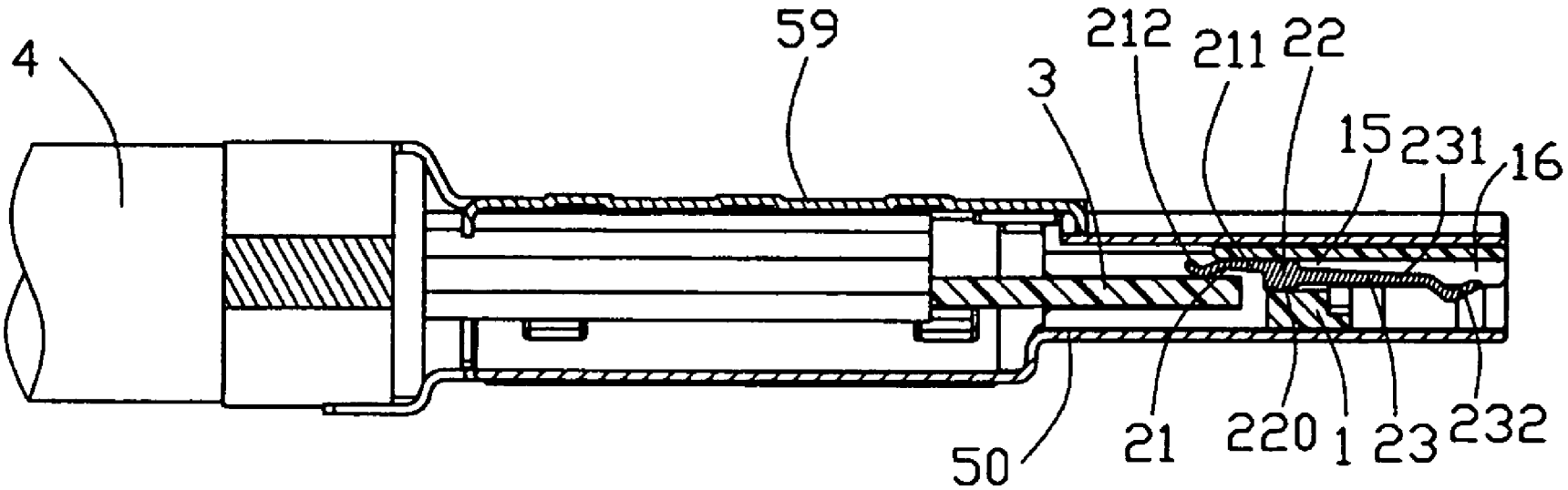
FIG. 7 is a cross-sectional view of FIG. 1 taken along line 7-7.

Referring to FIGS. 1-7, in assembly, the first and second terminals 20, 24 firstly and respectively pass through the passageways 15 with the cantilevering sections 231 of the mating portions 23 of the first and second terminals 20, 24 being respectively received in the slots 16, the contacting sections 232 of the mating portions 23 exposed out of the slots 16, the enlarged interconnecting portions 22 of the first and second terminals 20, 24 being received in and substantially fully occupying a cross-section of the passageways 15, and the tail portions 21 of the first and second terminals 20, 24 exposed between the pair of the connecting portions 11 of the insulative housing 1 and further supported by the bottom late (see FIG. 7, or a rear segment of the upper wall 12). The first and second terminals 20, 24 are reliably retained in the receiving space via the stings 220 of the first and second terminals 20, 24 abutting against the bottom inner surfaces of the passageways 15 and the flat portions 221 resisting the upper inner surfaces of the passageways 15. The first terminals 20 are more close to the mating interface than that of the second terminals 24 along the mating direction. Noticeably, the first terminals 20 are arranged in a line along the transversal direction perpendicular to the mating direction. The enlarged interconnecting 22 portions of the first terminals 20 are parallel to one another and separated by predetermined distance by a dielectric, e.g., a dielectric polymeric material, air or the like, located between them, such a physical capacitor also of a flat-plate type is formed. The second terminals 24 are arranged like that of the first terminals 20. In preferred embodiment, the dielectric is part of the insulative housing 1.

Then, the printed circuit board 3 is inserted into, and engaged with the insulative housing 1 due to a guiding of the guiding slits 110. During this insertion process, the soldering portions 212 of the tail portions 21 of the first and second terminals 20, 24 are soldered with the first and second pads 30, 31 for ensuring a reliable connection between the first and second pads 30, 31 and the tail portions 211 of the first and second terminals 20, 24, and the printed circuit board 3 is reliably retained in the guiding slits 110 by means of the strip ribs 1100 abutting against one surface of the printed circuit board 3, and obstructed from being inserted excessively by the blocks 1101. Next, the cable 4 is soldered with the printed circuit board 3. The conductors 40 are respectively and electrically connected with the third pads 32.

Referring to FIGS. 1-7, after that, the above assembly is inserted into and assembled with the metal shell 5 along the mating direction. During this assembly process, the insulatvie housing 1 is received in the receiving cavity 56. Further, the pair of lateral portions 121 is putted into the lateral protruding portions 5100 until the stopper portions 111 are obstructed by the rear surface of the main portion 51 of the first shell 50 with the first, second resilient tabs 5103, 5120 are respectively and elastically abutting against the recesses 1210, the securing slits 113 for holding the insulative housing 1 in the first shell 50 and preventing the insulative housing 1 from being pulled out. Then, the grounding layer of the cable 4 lies on the reinforcing portion 53 for supporting the cable 4. Additionally, the ribs 131 of the insulative housing 1 abut against one inner surface of the first shell 50 for providing an interferential fit therebetween. During this insertion process, the tongue portions 55 respectively slide along the lateral portions 121 and locate beyond a rear surface of the connecting portions 11.

Referring to FIGS. 1-7, then, the second shell 59 is assembled to the first shell 50 along the direction perpendicular to the mating direction, with the first and second latching pieces 5912, 5920 respectively being retained in the rectangular holes 5210 and the apertures 550. Thus, the upper wall 591 and the lateral walls 592 of the second shell 59 peripherally enclose the extending portion 52. The clamping portion 593 encloses the reinforcing portion 53 and the grounding layer of the cable 3 together and then solders with the reinforcing portion 53.

Referring to FIGS. 1-7, finally, the protecting cover 6 is molded over rear portions of the housing 1, the metal shell 4, the print circuit board 3, the terminals 2 and the conductors 40. Since the passageways 15 are substantially filled up by the enlarged interconnecting portions 22 of the terminals 20, the contacting portions 232 of the first terminals 20 and the second terminals 24 are free from being contaminated by the melt materials during over molding process of the protecting cover 6.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. An electrical connector assembly comprising:

an insulative housing defining a mating direction;

a plurality of terminals received in the insulative housing along the mating direction and each having a mating portion, a tail portion and an enlarged interconnecting portion connecting with the mating portion and the tail portion;

a printed circuit board attached to the insulative housing and electrically connected to the terminals;

a cable comprising a plurality of conductors electrically attached to the printed circuit board; and wherein the terminals comprise a plurality of first terminals for transmitting signal and a plurality of second terminals for transmitting power, the first terminals are arranged in a line along the transversal direction perpendicular to the mating direction, the enlarged interconnecting portions of the first terminals are parallel to one another and separated by a dielectric at predetermined distance such that a capacitor is formed.

2. The electrical connector assembly as described in claim 1, wherein the dielectric is part of the insulative housing.

3. The electrical connector assembly as described in claim 1, wherein the second terminals are arranged in another line that stands rear with respective to the first terminals and parallel to one another.

4. The electrical connector assembly as described in claim 1, wherein the insulative housing defines a mating interface with a substantially U-shape cross-sectional view for mating with a complementary connector.

5. The electrical connector assembly as described in claim 1, wherein the insulative housing comprises a base portion defining an upper wall, a lower wall extending parallel to the upper wall and being shorter than the upper wall, and a pair of lateral walls, the front portion of the base portion with a substantially U-shape cross-sectional view are formed by the upper wall, and the pair of the pair of lateral walls.

6. The electrical connector assembly as described in claim 5, wherein the upper wall, lower and lateral walls together define a receiving space which is divided into three parts relative to a plurality of passageways defined between inner surfaces of the upper wall and the lower wall and spaced from one another, a plurality of slots slotted in front portion of the upper wall and communicating with corresponding passageways along the mating direction and a mating space defined by the upper wall and the pair lateral walls and communicated with the passageways and the slots.

7. The electrical connector assembly as described in claim 6, wherein the mating portion comprise a cantilevering section and a contacting end, the enlarged portion further comprises at least a sting projecting downwardly thereof, the tail portion comprises flat portion and a soldering portion extending backwardly from the rear side of the flat portion.

8. The electrical connector assembly as described in claim 7, wherein the first terminals and the second terminals move toward the passageways with the cantilevering sections respectively received in the slots, the contacting sections extending out of the slots, the enlarged interconnecting portions being received in the passageways, and the tail portions exposed between the connecting portions of the insulative housing.

9. The electrical connector assembly as described in claim 8, wherein the stings of the enlarged interconnecting portions abut against the inner surface of the lower wall, the flat portions of the tail portions abut against the inner surface of the upper wall and the soldering portions are soldered onto the print circuit board.

10. The electrical connector assembly as described in claim 5, wherein the insulative housing further defines a pair of connecting portions unitarily formed with and rearwardly extending from the lateral walls along the mating direction, and each connecting portion comprises a guiding slit formed at a lower position of the inner wall thereof for guiding the print circuit board to the insulative housing.

11. The electrical connector assembly as described in claim 10, wherein the upper wall of the insulative housing comprises a flat part depressed a predetermined distance relative to the lateral portions and located between the pair of lateral portions.

12. The electrical connector assembly as described in claim 11, further comprising a metal shell enclosing the insulative housing, the rear portion of the terminal, the print circuit board and front end of the cable, and comprising a first shell and a second shell coupled to the first shell along a direction perpendicular to the mating direction.

13. The electrical connector assembly as described in claim 12, wherein the first shell comprises a pair of lateral protruding portions aligned with the lateral portions of the insulative housing and a flat portion depressed a predetermined distance relative to the lateral protruding portions and located between the pair of lateral protruding portions and aligned with the flat part of the insulative housing.

14. The electrical connector assembly as described in claim 10, wherein each lateral portion of the insulative housing comprises a recess downwardly slotted and rearwardly extending a given distance from a front surface thereof and stopped at a location adjacent to a rear surface thereof, and each lateral protruding portion forms a resilient tab inwardly extending therefrom and sliding across the recess during the process of assembly.

15. The electrical connector assembly as described in claim 12, wherein the first shell comprises a frame-shaped main portion, an extending portion rearwardly extending from the main portion and with a U-shape cross-sectional view taken along a direction perpendicular to the mating direction, and an reinforcing portion rearwardly extending from the extending portion.

16. The electrical connector assembly as described in claim 15, wherein the cable comprises a grounding layer laying on the reinforcing portion for achieving a grounding performance.

17. The electrical connector assembly as described in claim 16, wherein the second shell with a U-shape cross-sectional view comprises an upper wall, a pair of lateral walls opposite to each other which together define a cavity and lock with the extending portion of the first shell.

18. The electrical connector assembly as described in claim 17, wherein the second shell further comprises a clamping portion extending from the rear side of the upper wall and bending from a metal sheet to form a circular shaped structure, said clamping portion encloses the reinforcing portion and the grounding layer together.

19. A cable connector comprising:

an insulative housing defining a mating port in a front portion and a plurality of passageways extending in a front-to-back direction a plurality of contacts disposed in the housing, each of said contacts directly blanked from a metal sheet and thus defining main body having retention means thereon and defining a cross-sectional area substantially fully occupying a cross-section of the corresponding passageway, a contact section extending forwardly from the main body into the mating port, and a tail portion extending rearwardly from the main body; wherein a bottom face of the tail portion is supported by a bottom plate which extends rearwardly from a rear face of the housing.

20. The connector as claimed in claim 19, further including a printed circuit board, wherein an upper face of the tail portion is soldered upon the printed circuit board.

* * * * *